United States Patent [19]

Watson

[11] 4,448,920

[45] May 15, 1984

[54] REINFORCED ELASTOMER PRODUCTS

[75] Inventor: Stewart C. Watson, Williamsville, N.Y.

[73] Assignee: Watson-Bowman Associates, Inc., Getzville, N.Y.

[21] Appl. No.: 326,059

[22] Filed: Nov. 30, 1981

Related U.S. Application Data

[60] Continuation of Ser. No. 10,252, Feb. 8, 1979, Pat. No. 4,305,172, which is a division of Ser. No. 888,660, Mar. 21, 1978, Pat. No. 4,210,698, which is a continuation-in-part of Ser. No. 616,140, Sep. 24, 1975, Pat. No. 4,080,086.

[51] Int. Cl.[3] ..... C08K 3/08

[52] U.S. Cl. ..... 524/439; 524/440; 524/441

[58] Field of Search ..... 524/439, 440, 441; 428/325, 328, 331

[56] References Cited

U.S. PATENT DOCUMENTS

| | | | |
|---|---|---|---|
| 3,152,099 | 10/1964 | de Gaugue | 524/440 |
| 3,255,152 | 6/1966 | Kniege | 524/439 |
| 3,629,051 | 12/1971 | Mitchell | 524/441 |
| 3,668,168 | 6/1972 | Self | 524/440 |
| 3,895,143 | 7/1975 | Tarlow | 524/439 |

*Primary Examiner*—Lewis T. Jacobs

*Attorney, Agent, or Firm*—Michael L. Dunn

[57] ABSTRACT

The resistance of structural elastomer products, such as bearing blocks, to compressive forces is reduced by incorporating therein a plurality of small, separate, reinforcing elements of relatively hard material. Such materials include crushed rock, concrete, glass or certain slags and small metal pieces. The reinforcing elements are congregated in an interior section or core which is covered by a marginal section substantially free from reinforcing elements.

7 Claims, 2 Drawing Figures

REINFORCED ELASTOMER PRODUCTS

This is a continuation of application Ser. No. 10,252, filed Feb. 8, 1979, now Pat. No. 4,305,172, which is a division of Ser. No. 888,660, filed Mar. 21, 1978, now U.S. Pat. No. 4,210,698, which in turn is a continuation-in-part of Ser. No. 616,140, filed Sept. 24, 1975, now U.S. Pat. No. 4,080,086.

BACKGROUND OF THE INVENTION

This invention relates to the production of reinforced elastomer materials and products made therefrom and is particularly concerned with structural elastomer products. Rubber and related or similar elastomers have previously been employed in the manufacture of load-bearing devices, such as bearing blocks, in cases where resilience and flexibility are desirable. A disadvantage of such use has been that under conditions of high loading the elastomer is squeezed and deforms, in some instances resembling a very viscous liquid, thereby losing its desirable structural qualities. To minimize or prevent such deformation it has been customary, when molding large structural elements of rubber or other elastomer, to embed in the molded product a plurality of spaced metal plates so arranged as to prevent excessive deformation of the product under load or compression. In many cases this measure presents molding difficulties. However, since in some instances the load on such structural products is quite high, 1000 psi or more, reinforcement is required.

SUMMARY OF THE INVENTION

By the present invention the deformation of structural elastomer products under compressive stresses is prevented, minimized, or controlled by incorporating in the product a plurality of small, separate, reinforcing elements. These elements, which are of relatively hard material compared to the elastomer may be formed of a variety of materials. Fragments of crushed rock, concrete, glass, and certain slags are convenient and inexpensive. Also in many cases a substantial number of such fragments are irregular in shape, i.e. elongated in one direction, so that they tend to interlock through the elastomer when subjected to compressive force. Small particles, which may be regular in shape, of metal can also be used. The separate reinforcing elements are congregated in a central, interior portion or core of the product and surrounded on all sides by a marginal portion substantially free from reinforcing elements. These reinforcing elements may be separated one from another.

SHORT DESCRIPTION OF THE DRAWINGS

Figure 1:
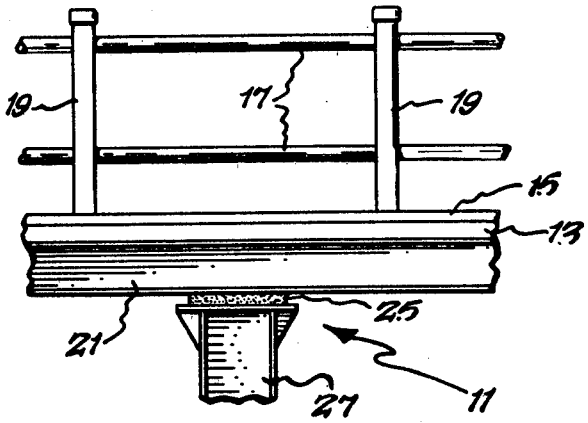
Figure 2:
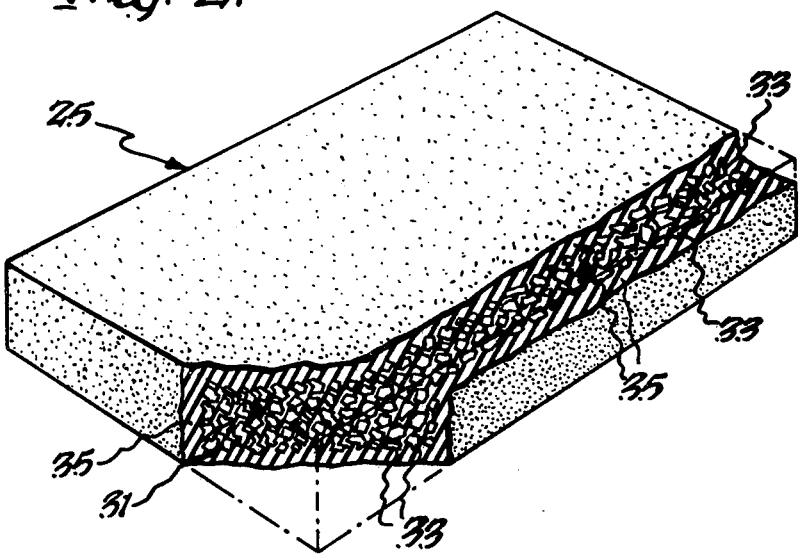

FIG. 1 is a fragmentary elevation of a conventionalized bridge showing an elastomeric bearing block for a bridge girder; and FIG. 2 is a perspective view, partially broken away, showing a bearing block, of the type illustrated in FIG. 1, according to the present invention.

DESCRIPTION OF THE INVENTION

Although structural elastomer products according to the present invention may take various shapes and be of various sizes, there is illustrated in the accompanying drawing and hereinafter described a bearing block of the type employed on the tops of piers or posts for supporting the longitudinal girders of bridges or overpasses. There are, of course, many other uses for structural elastomer products. For example, they are employed in the support of buildings to reduce the transmission of vibration and similar use is made of them for mounting machines and instruments. Reinforcement of elastomer products employed for these and other purposes where there is need for control of deformation and dimensions is also possible in accordance with the present invention.

In the drawings which illustrate a typical embodiment of the present invention, FIG. 1 shows, somewhat diagrammatically, a portion of a bridge that is designated generally as 11. The bridge has a pavement slab 13, a pavement surfacing 15, horizontal railings 17 carried by vertical posts 19, and longitudinal girders 21 which rest on bearing blocks 25 of suitable elastomeric material carried on supporting posts or piers 27. As shown in FIG. 2, the elastomeric bearing block 25 comprises a central interior section or core 31 in which separate reinforcing elements 33 are congregated and a surrounding, marginal section 35 adjacent its outer faces which is substantially free from such elements.

The composition of the elastomer used in carrying out the present invention may vary. Natural rubber may be used, as well as synthetic rubbers, for example butyl, ethylene-propylene, and silicone rubbers. Polyurethane is also usable. Neoprene is often preferred because of its resistance to solvents as well as weathering under the influence of environmental factors such as sunlight and ozone and attack by soil bacteria.

The reinforcing elements 33 should be harder than the elastomer employed and not easily crushed. Fragments of a crushed rock, such, for example as granite, are suitable. Since in many cases a substantial number of such fragments are irregular in shape, that is elongated in one direction, they tend to interlock through the elastomer of the block 25 when subjected to compressive force whereby the elastomer is restrained and prevented from flowing freely. Thus, even under high compressive stress, the vertical dimension or deflection of the elastomer block is at least controlled or predictable. Reinforcing elements of other materials can, of course, be used, for example crushed concrete, glass, or certain slags and small metal pieces which may in some cases be regular in shape. The reinforcing effect of the elements is increased when the elements are wet by the elastomer. It is, therefore, desirable to employ a combination of elastomer and reinforcing elements in which the latter are wet by the former or to provide a treatment for the elements which will enhance their wetability.

It will be understood that the proportion of reinforcing elements present in an elastomer product may be varied to achieve the desired structural properties in the product. The proportion of and hardness of the elements used will depend upon the type of elastomer and the purpose of the product. It will be evident that reinforcing with hard materials permits the use for structural products of relatively soft elastomers, for example oil extended rubber, since the resistance to deformation by compressive forces may thereby be greatly increased. This illustrates a coincidental matter, that, by suitable choice of elastomer and reinforcing elements, products with different specific gravities and structural characteristics may be readily produced. It should also be noted that the reduction in the amount of elastomer in products produced according to the present invention will permit shorter curing times and thus increase the production rate.

It is important for the block 25 to have the marginal section 35 around the reinforcing element-containing core or interior section 32. This prevents loss of elements from the block during handling and dislodgement of elements by frictional, vibrational, or shock forces during use, thus causing change in the structural properties of the block.

Although in the foregoing specification and the accompanying drawings there is described and illustrated a bearing block for bridges and overpasses, it will be recognized that the invention is not so limited and that the invention should be construed as broadly as permitted by the following claims.

I claim:

1. An elastomeric load bearing device capable of withstanding large compressive forces without substantial dimensional deformation, said device having an interior core section and an exterior marginal section surrounding the core section on all sides, said core section consisting of an elastomeric binder and a sufficient amount of a filler of metal particles to reduce deformation of the device, the exterior marginal section consisting of an elastomer substantially free of the metal particles of the interior core section.

2. A product as defined in claim 1 wherein a major portion of said elements are elongated in one direction.

3. A product as defined in claim 1 wherein said elements are irregular in shape.

4. A process for increasing the resistance to deformation of an elastomeric load bearing device from large compressive forces, said device having an interior core section consisting of an elastomeric binder and an exterior marginal section consisting of an elastomer surrounding the interior core on all sides, said process comprising incorporating a sufficient amount of a filler of metal particles in the interior core section to reduce deformation of the device while the exterior marginal section remains substantially free of the metal particles of the interior core section.

5. A process as set forth in claim 4 in which said elements are congregated in a core section of said body but are separated one from another.

6. A process as set forth in claim 4 in which said elements are irregular in shape.

7. A process as set forth in claim 6 in which a major portion of said elements are elongated in one direction.

* * * * *